US009237619B2

(12) United States Patent
Van Den Broeke

(10) Patent No.: US 9,237,619 B2
(45) Date of Patent: Jan. 12, 2016

(54) DIMMABLE LED LIGHTING CIRCUITS, CONTROLLERS THEREFOR AND A METHOD OF CONTROLLING A DIMMABLE LED LIGHTING CIRCUIT

(71) Applicant: NXP B.V., Eindhoven (NL)

(72) Inventor: Leendert Van Den Broeke, Malden (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 14/253,552

(22) Filed: Apr. 15, 2014

(65) Prior Publication Data

US 2014/0312787 A1 Oct. 23, 2014

(30) Foreign Application Priority Data

Apr. 23, 2013 (EP) ..... 13164929
Nov. 27, 2013 (EP) ..... 13194657

(51) Int. Cl.
*H05B 33/08* (2006.01)

(52) U.S. Cl.
CPC ..... *H05B 33/0845* (2013.01); *H05B 33/083* (2013.01); *H05B 33/0857* (2013.01)

(58) Field of Classification Search
CPC ..... H05B 33/0845; H05B 33/0812; H05B 33/0833
USPC ..... 315/185 R, 193, 294, 306
See application file for complete search history.

(56) References Cited

U.S. PATENT DOCUMENTS

| | | | | |
|---|---|---|---|---|
| 7,843,148 | B2 | 11/2010 | Gater et al. | |
| 8,203,260 | B2 | 6/2012 | Li et al. | |
| 2010/0102732 | A1 * | 4/2010 | Peeters et al. | 315/161 |
| 2010/0109570 | A1 | 5/2010 | Weaver et al. | |
| 2011/0068702 | A1 | 3/2011 | van de Ven et al. | |
| 2012/0001555 | A1 | 1/2012 | Tu et al. | |
| 2012/0038286 | A1 | 2/2012 | Hasnain | |
| 2012/0306375 | A1 | 12/2012 | Van de Ven | |
| 2013/0049602 | A1 | 2/2013 | Raj et al. | |

FOREIGN PATENT DOCUMENTS

AU 2012 100 032 A4 2/2012

OTHER PUBLICATIONS

Extended European Search Report for EP Patent Appln. No. 13164929.5 (Apr. 2, 2014).
Extended European Search Report for EP Patent Appln. No. 13194657.6 (Apr. 24, 2015).

* cited by examiner

*Primary Examiner* — Daniel D Chang

(57) ABSTRACT

Controllers (360, 360'), lighting circuits and methods are disclosed, for a dimmable LED lighting circuit having a series arrangement of two types of LED, the controller comprising a control circuit (330), a bypass circuit (340) and optionally a further bypass circuit and being operable for controlling a current, the current (Idriver) being separable into first and second parts ($I_W$, $I_B$), and into further first and second parts, wherein the controller is configured to direct the (further) first part through the LED or LEDs of the second (first) type and direct the (further) second part through the (further) bypass circuit (respectively), and wherein the control circuit is configured to adjust the ratio between the first, or further first, part and the second, or further second respectively, part in dependence on a dimming level of the LED lighting circuit.

20 Claims, 5 Drawing Sheets

DIMMABLE LED LIGHTING CIRCUITS, CONTROLLERS THEREFOR AND A METHOD OF CONTROLLING A DIMMABLE LED LIGHTING CIRCUIT

CROSS-REFERENCE TO RELATED APPLICATIONS

This application claims the priority under 35 U.S.C. §119 of European patent application no. 13194657.6, filed on Nov. 27, 2013 and European patent application no. 13164929.5 filed Apr. 23, 2013, the contents of which are incorporated by reference herein.

FIELD OF THE INVENTION

This invention relates to dimmable lighting circuits, to controllers therefore and to methods of controlling dimmable LED lighting circuits.

BACKGROUND OF THE INVENTION

LED light sources differ significantly from incandescent light sources in that they typically produce light, the colour of which does not change significantly with their brightness. This is particularly apparent when an LED light source is used to replace a dimmable incandescent lamp. Depending on the brightness of the light, incandescent lamps produce light with a colour temperature between 1800K, when the lamp is deep dimmed, and 2700K when the lamp is at full brightness or even up to 3000K for an undimmed halogen lamp. During dimming the colour temperature of an incandescent follows the so-called black-body curve. In contrast to incandescent lamps, LEDs have an almost constant colour temperature of for example 3000K or 3500K independent of the dimming level.

To overcome this perceived problem, it is known to mimic an incandescent light by using a mixture of LED light sources which emit different spectral contents of light. For each brightness level, set by for example a wall-dimmer or remote control, the mixture is adjusted to mimic an incandescent light source. The solution is generally referred to as "Tunable White" or "Correlated Colour Tracking".

It is possible to use different combinations of LED light sources to achieve the same effect. Some examples of combinations of coloured light sources, known as primaries, which have been used are: warm white combined with amber; cold white combined with amber; red combined with green and blue; and warm white combined with red and green. A warm white LED may typically be one having a colour temperature of 3000±100 K; conversely, a cold white may typically have a colour temperature of 3500±100 K. Although their Colour Rendering Index (CRI) may be of different quality, in principle any combination can be used, as long as the colour coordinates of the primary light sources in the XY colour plane cover the relevant part of the black body curve.

Warm or cold white combined with amber are particularly convenient combinations since, firstly, only two primary types of LEDs are required and so only two drive currents need to be adjusted. And secondly, both primaries are already located on the black-body curve, and as a result inaccuracies in the mixing do not result into colour deviations that appear unnatural.

As will be described in more detail hereinbelow, more than one LED may be used in series, for one or both of the primaries. Such a series arrangement is generally referred to as a string. In order to keep the cost of the driver low, the two LED strings will typically be supplied by a single output switching LED driver.

In known arrangements, the two strings are arranged in parallel. An example is shown in FIG. 1. This arrangement 100 which has a first string 110—in this case a single LED which may be for instance an amber LED, and a second string 120, which may be for instance white LEDs. The current being supplied from an LED driver 150, which may be either a linear type or switching type, is directed into both strings, and the fraction which is directed towards the first string is controlled by a controller 130 which uses some sort of regulated analogue current source circuit 140. Due to a difference in total forward voltage between the strings, the power efficiency may be expected to be low whenever both strings are simultaneously conducting current. For this reason, at maximum light output at which the white LEDs conduct full current, the current through the amber LED will be reduced to, or almost to, zero. Thus the amber LEDs do not contribute to the maximum luminance output from the light source, and at maximum brightness, all the light to come from the white LEDs. It will be apparent, that this is not an ideal solution, from a cost point of view, since the cost-efficiency of such a system, in lumens-per-dollar, is lower than would be the case, were the amber LED also to be contributing.

In another known arrangement, an example 200 of which is shown in FIG. 2, the current is switched to either of the first string 210 or the second string 220 in a sequential manner, by means of switches 240 and 245 under the control of controller 230. The problem of reduced power efficiency may be avoided, because the switching LED driver may be arranged to sequentially adapt to the individual forward voltages. However, this results in a complicated switching LED driver which may also be specific to a particular arrangement of LED strings and thus incompatible with standard switching LED drivers. Further, since LED operating efficiencies (measured in lumens/watt) are generally highest at constant current, buffer capacitors may be required in parallel with the LEDs to achieve the highest efficiencies.

SUMMARY

According to a first aspect there is provided a controller, for a dimmable LED lighting circuit comprising an arrangement of at least one LED of a first type connected in series with at least one LED of a second type, the controller comprising a control circuit, a bypass circuit and a further bypass circuit and being operable for controlling a current, the current being separable into a first part ($I_W$) and a second part ($I_B$), and being further separable into a further first part ($I_A$) and a further second part ($I_{B2}$), wherein the controller is configured to direct the first part through the at least one LED of the second type and direct the second part through the bypass circuit, wherein the controller is configured to direct the further first part through the at least one LED of the first type and direct the further second part through the further bypass circuit, and wherein the control circuit is configured to adjust at least one of (a) the ratio between the first part and the second part, and (b) the ratio between the further first part and the further second part, in dependence on a dimming level of the LED lighting circuit.

According to a second aspect there is provided a controller, for a dimmable LED lighting circuit comprising an arrangement of at least one LED of a first type connected in series with at least one LED of a second type, the controller comprising a control circuit and a bypass circuit and being operable to direct a current comprising a first part ($I_W$) and a second part ($I_B$) through the at least one LED of the first type, wherein the controller is configured to direct the first part through the at least one LED of the second type and direct the second part through the bypass circuit, wherein the control circuit is configured to adjust the ratio between the first part and the second part in dependence on a dimming level of the LED lighting circuit. Thus this aspect is analogous to a particular case of the first aspect, in which the ratio between the further first part and the further second part is infinitely large, such that the further second part is zero, as a result of which the further bypass circuit would be redundant since no current would flow through it and is thus not present.

Thus embodiments may provide a low-cost solution which may be simple to implement and may be compatible with a standard off-the-shelf LED driver.

In embodiments the bypass circuit comprises a controllable current source. In embodiments, the bypass circuit comprises a transistor configured to be operated in a linear mode. The amount of current through the bypass circuit may thus be adjusted by controlling the control terminal of the transistor. In other embodiments, the bypass circuit comprises a pair of transistors connected as an output stage, and configured to operate in linear mode. Use of a pair of transistors may reduce the overall cost of the circuit.

In embodiments, the bypass circuit may comprise a switch operable with pulse width modulation. Regulation of the bypass circuit may thus be, for example, PWM, and in particular is not limited to linear regulation.

In embodiments, either the controller or the bypass circuit is configured to supply the first part from a power source having a higher voltage than a power source which supplies the second part. Thereby, the voltage drop across the bypass circuit may be made to be less than the voltage drop across the at least one LED of the second type. Thus Ohmic losses associated with the bypass circuit may be reduced or minimised. In other embodiments, either the controller or the bypass circuit is configured to supply the first and second parts from a single power source.

In embodiments the control circuit is operable to measure the first part and the second part, and comprises: a first pair of transistors arranged as a first error amplifier operable to adjust the ratio between the first part and the second part over a first range of dimming levels, and a second pair of transistors arranged as a second error amplifier and operable to adjust the ratio between the first part and the second part over a second range of dimming levels, wherein the first and second error amplifiers having a one transistor in common. In particular, the first dimming range may be a deep dimming level, and the second dimming range may be a brighter level. The ratio between the first part and the second part maybe fixed over the first range of dimming levels, and may vary over the second range of dimming levels such that as the brightness increases more of the current is directed through the at least one LED of the second type. Moreover, the second error amplifier may have a transistor in common with one of the transistors in the output stage, this transistor being separate to the transistor which is in common between the first error amplifier and the second in error amplifier.

According to another aspect there is provided a lighting circuit comprising a controller as described above, and further comprising a series arrangement of at least one LED of a first type connected in series with at least one LED of a second type. The lighting circuit may comprise the power supply.

In embodiments, the lighting circuit further comprises an LED driver operable as the power source to provide a drive current Idriver. In other embodiments, the LED driver is operable as the power source to supply the first part from a first output and the power source to supply the second part from a second output.

According to a further, aspect, there is provided a method of controlling an LED lighting circuit comprising an arrangement of at least one LED of a first type connected in series with at least one LED of a second type, the method comprising: providing a current, wherein the current comprises a first part through the at least one LED of the second type and a second part which bypasses the at least one LED of the second type and wherein the current comprises a further first part through the at least one LED of the first type and a further second part which bypasses the at least one LED of the first type.

According to a yet further aspect, there is provided a method of controlling an LED lighting circuit comprising an arrangement of at least one LED of a first type connected in series with at least one LED of a second type, the method comprising: providing a current through the at least one LED of the first type wherein the current comprises a first part through the at least one LED of the second type and a second part which bypasses the at least one LED of the second type.

In embodiments, the first type is an amber LED and the second type is a white LED. By generally increasing the relative contribution of the LEDs of the second type, which may typically correspond to a higher colour temperature, the perceived colour temperature of the arrangements may be increased with increasing brightness. It will be appreciated, that in less typical embodiments it may that the LEDs of the first type have a higher colour temperature, in which case, increasing brightness might generally result in a perceived lower colour temperature.

In embodiments, the at least one LED of the first type is one LED and the at least one LED of the second type is three LEDs. In other embodiments, the at least one LED of the first type is a first plurality of LEDs and the number of LEDs in at least one LED of the second type is three times the first plurality of LEDs.

These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which.

Figure 1:
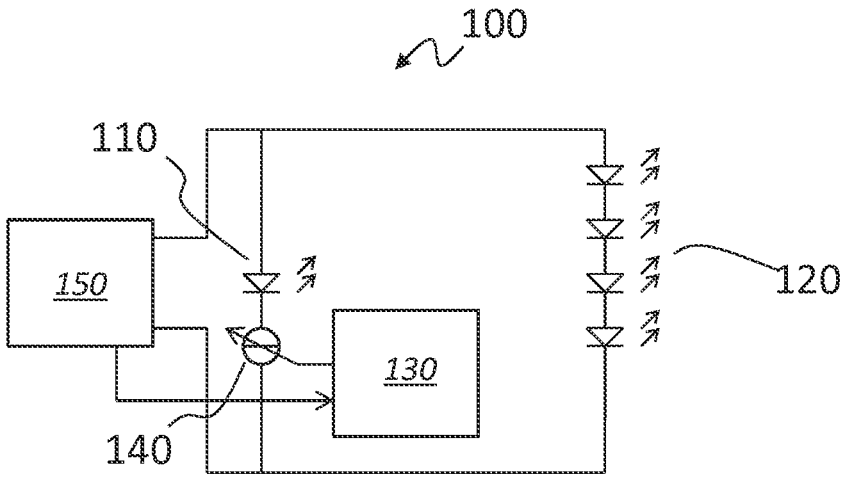
FIG. 1 shows, schematically, a known LED lighting circuit arrangement, in which two strings are arranged in parallel.
Figure 2:
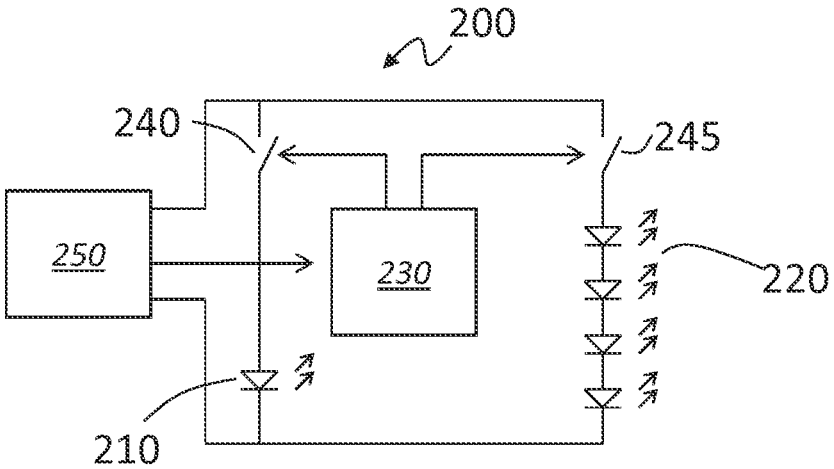
FIG. 2 shows, schematically, another known LED lighting circuit arrangement again with two strings in parallel.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments.

DETAILED DESCRIPTION OF EMBODIMENTS

Figure 3A:
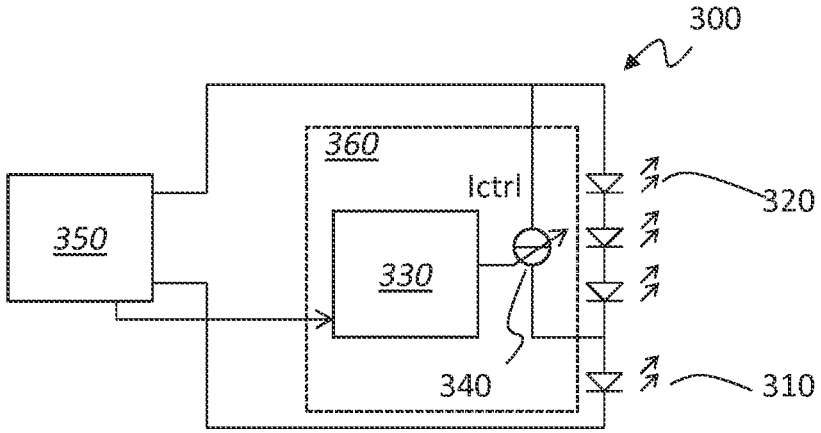
FIG. 3A shows, schematically, an LED lighting arrangement according to an embodiment.

FIG. 3A shows, schematically, an LED lighting arrangement 300 according to embodiments, with two strings arranged in series; the arrangement comprises a first string of at least one LED of a first type 310 connected in series with a second string of at least one LED of a second type 320. As shown, the first string may be a single LED. It may be an amber LED. The second string may be a string of for example 3 LEDs as shown, which may be white LEDs. The arrangement 300 includes a control circuit 330 and a bypass circuit 340. The bypass circuit 340 may be a variable current sink, and is for sinking (or sourcing) a controllable current $I_B$. A driver 350, which may be comprised in the arrangement 300, supplies an LED drive current Idriver. The LED drive current Idriver is split into two parts. The first part $I_W$ is directed through the second string 320, and the second part $I_B$ is directed through the bypass circuit. Thus all of the drive current is directed through the first string 310, whereas only a part—in particular the first part $I_W$—of the drive current is directed through the second string 320.

The control circuit 330 and the bypass circuit 340 may together form a controller 360.

The control circuit is configured to adjust, in use, the ratio between the first part and the second part in dependence on a dimming level of the LED lighting circuit. A variety of different schema or arrangements may be used for this adjustment, examples of which will be described in more detail hereinunder. In general, however, at deep dimming levels—that is to say for small values of overall drive current Idriver—the fraction of the light output which is provided by the second string 320 is low. In contrast, at high brightness levels—that is to say for large values of overall drive current Idriver—the fraction of the light output which is provided by the second string 320 is higher.

Thus in the case of a tunable white application, at deep dimming levels, most of the light output is provided by the string 310 of amber LEDs. In contrast, at high brightness levels, a higher part of the light output is provided by the string 320 of white LEDs.

It will be appreciated that, at all dimming levels, the first string of LEDs, that is to say in this application the amber LED or LEDs, is driven with the complete driver current Idriver. Thus this LED (or these LEDs in the case that the string comprises a plurality of LEDs) contributes to the overall luminance output at all dimming levels. This is in contrast to known arrangements wherein the strings are arranged in parallel, in which typically the amber LEDs do not contribute at full brightness. In typical known tunable white applications, a single amber LED is used in parallel with a string of four white LEDs.

In or with embodiments, the string of four white LEDs may be replaced by a string of three white LEDs, and yet the same maximum luminance output may be achieved, since the amber LED is contributing and an amber LED typically produces the same amount of luminance for a given current as a white LED, at around 100 lumen for a 350 Ma drive current.

Figure 3B:
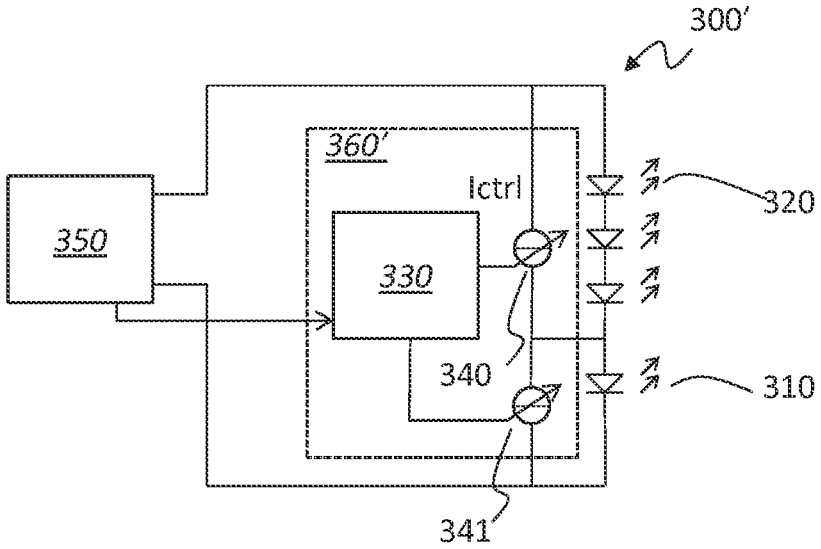
FIG. 3B shows, schematically, an LED lighting arrangement according to an embodiment.

FIG. 3B shows, schematically, an LED lighting arrangement 300' according to other embodiments. This arrangement is generally similar to that shown in FIG. 3A however, in these embodiments, it is possible to direct part of the total LED current supplied by unit 350 through a second, or further, bypass circuit 341, so as to bypass the first string of at least one LED 310. In such embodiments, not all of the current provided by the driver flows through the or each LED 310: instead, some of the current bypasses this or these LEDs, by means of the second, or further, bypass circuit.

Similar to bypass circuit 340, bypass circuit 341 may be a variable current sink, and is for sinking (or sourcing) a controllable current $I_{B2}$. In these embodiments, the LED drive current Idriver is not only split into two parts $I_W$ and $I_B$, directed respectively through the second string 320 and the bypass circuit; rather it is further split into a further two parts, $I_A$ and $I_{B2}$: The first further part $I_A$ is directed through the first string 310, and the second part $I_{B2}$ is directed through the further bypass circuit 341. In such embodiments, in contrast to that depicted in FIG. 3A all of the drive current is generally not directed through the first string 310, but rather only a part—in particular the further first part $I_A$—of the drive current is directed through this first string 310.

It will be apparent that splitting the current into further two parts does not involve sub-splitting the already split current; rather the driver current may comprise or consist of the first and second part, and it may, independently comprise or consist of the further first part and the further second part. Thus in general in such embodiments, the condition applies that:

$$Idriver=I_W+I_B=I_A+I_{B2}$$

In such embodiments, the control circuit 330, the bypass circuit 340 and the further bypass circuit 341 may together form a controller 360'. Such embodiments may therefore allow a decreasing contribution from the LEDs of the first type: this may be useful for instance in order to tune the colour point more towards the colour from the second type of LEDs at high light output. It will be appreciated that such embodiments might not benefit from all the LEDs fully contributing to the luminous output, so more LEDs may be required for the same luminance output, relative to embodiments as shown in FIG. 3A.

Figure 4:
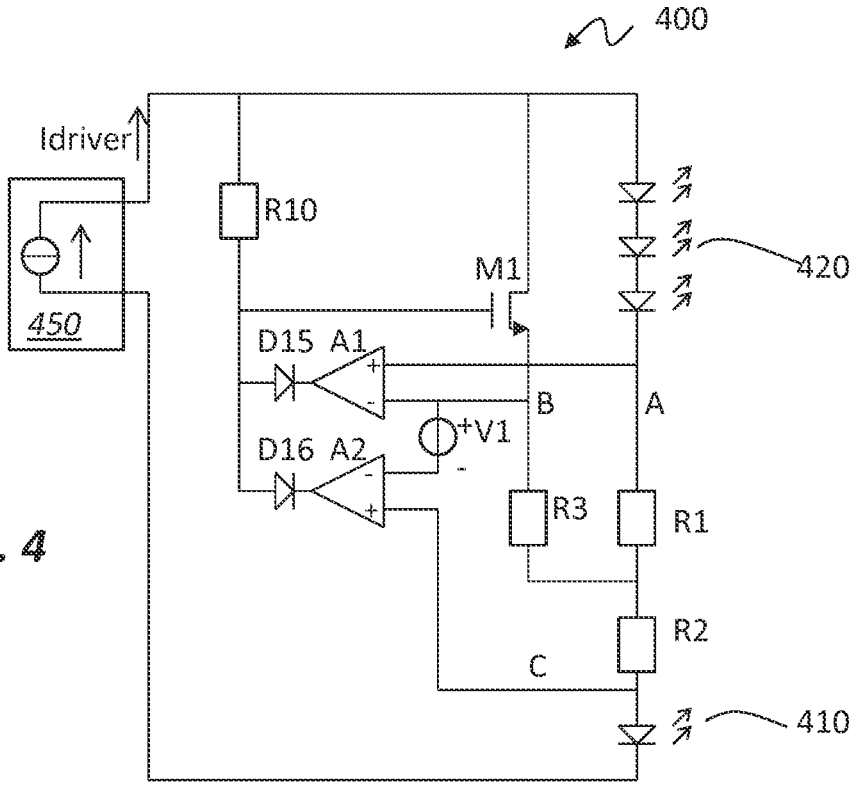
FIG. 4 shows a more detailed LED lighting arrangement according to embodiments.

FIG. 4 shows a more detailed LED lighting arrangement 400 according to embodiments shown in FIG. 3A. A standard dimmable driver circuit 450 operates as a current source and provides a current Idriver. Part of this current is directed through the second string 420 of LEDs of a second type—which may be white LEDs—and which is arranged in series with the first string 410 of LEDs of a first type—which may be amber LEDs. Included in the series arrangements are two sense resistors R1 and R2. R2 senses the current Idriver through the first string of LEDs 410. R1 senses the current 6 through the second string of LEDs 420. The current 6 through R1 may be lower than the current Idriver through R2 due to current $I_B$ through a bypass path which comprises transistor M1. The bypass path is arranged between the driver 450 and the first string 410 so as to bypass the second string 420. A third sense resistor R3 is included in the bypass path, connected between a node between R1 and R2, and the transistor M1.

To simplify the following explanation of the operation of the circuit, the following nodes are shown: node A is at the junction between the first sense resistor R1 and the second string 420; node B is at the junction between the third sense resistor R3 and the transistor M1, and node C is at the junction between the second sense resistor R2 and the first string 410.

Two error amplifiers, A1 and A2, having respective blocking diodes D15 and D16 connected in series with their outputs, are arranged to control the control terminal of transistor M1. They thereby adjust the current $I_B$ through the bypass path, and thereby adjust the ratio of the currents through the first and second strings, in dependence on the overall driver current Idriver—and thus in dependence on the dimming level, since Idriver also determines the overall dimming level.

At deep dimming levels, the circuit consisting of R1, R3, A1, D15, R10 and M1 splits the current into two parts as determined by the ratio of the resistors R1 and R3. To this purpose, the first amplifier A1 measures the voltage between the nodes A and B, which is the difference between the voltage drops across sense R1 and R3. If the voltage differs significantly from zero, the current through the MOS transistor M1 is regulated to correct for this unbalance. Thus, by suitable choice of the values of sense resistors R1 and R3, the ratio of the currents through the first and second strings, and in particular the fraction of the current through the first string which also passes through the second string, may be predetermined. As will be familiar to the skilled person, the sense resistors should generally be chosen to have a low resistance so as to minimise the ohmic losses associated therewith. In a typical example, R1 may be given the value of 4 ohm and R3 many given a value of 1.5 ohm. In more detail, since the regulation acts to eliminate difference in voltages between the resistors R1 and R3, and $I_B+I_W$=Idriver, the application of Ohm's law "V=I·R" results in $I_B \cdot R3 = I_W \cdot R1$, so the fraction, $I_W$/Idriver, of the total driver current which passes through the second string, is given by:

$$\frac{I_W}{I_{driver}} = \frac{I_W}{I_W \cdot I_W \cdot \frac{R_1}{R_3}} = \frac{R_3}{R_1 + R_3} \quad (1)$$

If R3 is been chosen to much smaller than R1, at low brightness the amber LED will conduct a much higher current than the white LEDs, and so the colour of the emitted light will be close to amber, that is to say, will have a low colour temperature.

Although by decreasing R3 relative to R1, the fractional bypass current may be increased to tune the colour more towards saturated amber, the skilled person will appreciate that there is a good reason to keep some minimum current through the white LEDs, because the current through the white LEDs will assure that the total load voltage as seen by the LED driving current remains high enough to assure proper switching operation of the switching LED driver. The skilled person will appreciate that switching LED drivers typically require a certain minimum output voltage in order to keep up the supply voltage of the switch driver IC that gets its supply from an auxiliary winding that is reflecting the converter load voltage.

The first input to the second error amplifier is connected to node C, and its second input is connected to the second input of the first error amplifier—that is to say, node B—via a voltage offset V1. As the brightness—that is to say, the magnitude of Idriver—is increased to a higher value, at some point the voltage drop across R2 becomes high enough to activate the second error amplifier A2 and series output diode D16. From that point onwards, the amplifier A2 senses the voltage difference between voltages at nodes B and C, after subtraction of the offset voltage V1. If the amplifier input voltage deviates significantly from zero, the transistor M1 is regulated to correct for this. The result of all this is that with increasing brightness, the current through the amber LED is gradually becoming equal to the current through the white LED.

Thus, the point at which the second error amplifier comes into action can be tuned by changing the offset voltage V1 and the value of R2. The steepness of the control depends on the ratio between R3 and R2.

Figure 5:
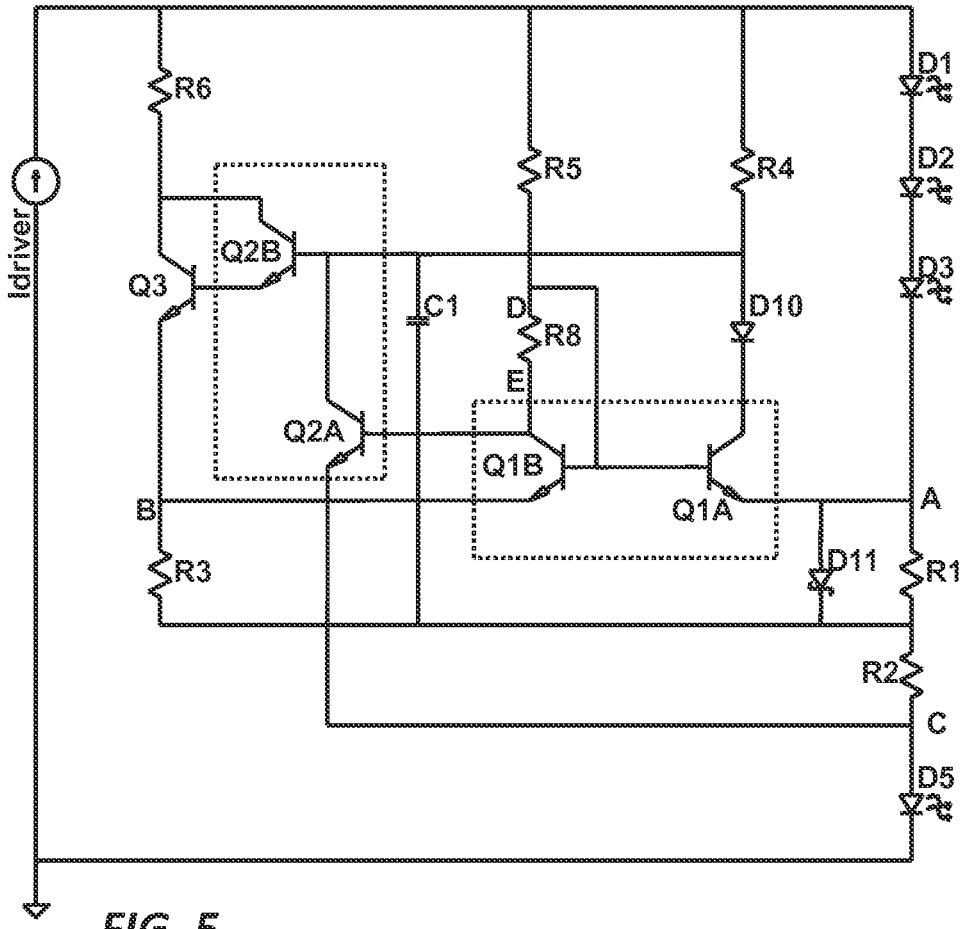
FIG. 5 shows a circuit diagram of the LED lighting arrangement according to embodiments.

FIG. 5 shows a circuit diagram of the LED lighting arrangement according to embodiments. The circuit diagram implements an embodiment as shown in FIG. 4. The amplifier A1 has been implemented using the bipolar transistors Q1A, Q1B, D10 and R4. The MOST M1 is replaced by a bipolar transistor output stage consisting of Q2B and Q3. The amplifier A2 has been implemented using the bipolar transistor Q1B and Q2A. The function of the diode D16 shown in FIG. 4 is implicitly included in Q2A. The offset voltage V1 is implemented by R8 which conducts an approximately constant current.

The point at which the second error amplifier comes into action can be tuned by changing the voltage drop across R8 and the value of R2. The voltage drop across R8 can be increased but it should be prevented that Q1B starts to operate in saturated mode. As described above, the steepness of the control depends on the ratio between R3 and R2.

In this embodiment, a schottky diode D11 is included in parallel with the sense resistor R1 and serves to limit the voltage drop across R1 beyond the regulation range of the first error amplifier around Q1A and Q1B. Inclusion of this diode reduces dissipation and so may improve power efficiency.

In embodiments, a resistor R6 is added in series with M1, or Q3, in order to shift part of the power dissipation at medium dimming level from Q3 to R6.

The skilled person will appreciate that the transition points in the control curves are smooth rather than steep. This is due to the limited voltage gain of the error amplifier but is not a problem for the application.

It will further be appreciated that in embodiments such as that shown in FIG. 5, the transistors Q1A and Q1B may be well-matched. To achieve this, it may be appropriate to use two transistors in a single package. In particular, this may facilitate or enable very low minimum brightness and be appropriate in embodiments in which the voltage drop across R1 and R2 is low to minimise ohmic losses. However, a mismatch between Q2A and Q1B is less liable to result in instability or incorrect operation.

A capacitor C1 may be included between the node between R1 and R2, and the control terminal to M1, or Q2B, in order to improve the stability of the regulation loop.

Figure 6A:
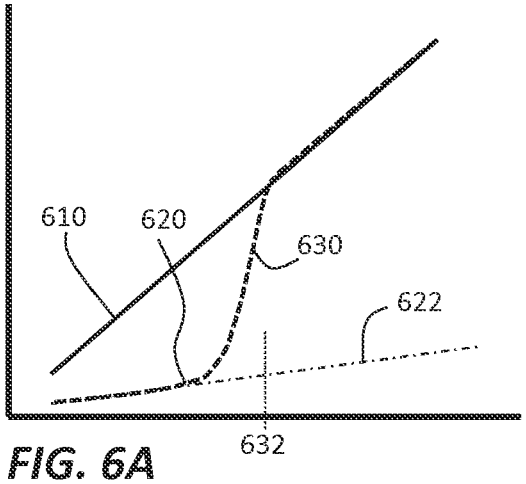
FIG. 6A shows the operating curve of an LED lighting arrangement according to an embodiment.

FIG. 6A shows the operating curve of an LED lighting arrangement according to embodiments. The figure shows, at 610, the current through the first string, and, at 620, the current through the second string, on the y-axis or ordinate, plotted against the driver current Idriver, on the x-axis. Since all the current flows through the first sting, curve 610 is a straight line, increasing at an angle of 45%. The shape of the second curve 620 is explained as follows: At low values of Idriver, that is to say deep dimming levels, the curve 420 follows a straight line 622 with a shallow gradient. This gradient is determined by the fraction of the overall driver current I driver which goes through the second string 420, and, as described above, for embodiments such as that shown in FIG. 4, is thus determined by the ratio of R1 and R3 according to equation (1). Again, as discussed above, in relation to FIG. 4, for higher values of the driver current Idriver—that is to say for higher brightness, the bypass path is regulated so a smaller fraction of the current bypasses the second string, and in consequence 6 increases relative to Idriver, as shown at 630 until it at a particular value of the driver current shown at 632, all the current through the first string also passes through the second string, such that none is directed through the bypass path. For yet higher currents, curve 620 follows curve 610 since all the current passes through both strings.

Figure 6B:
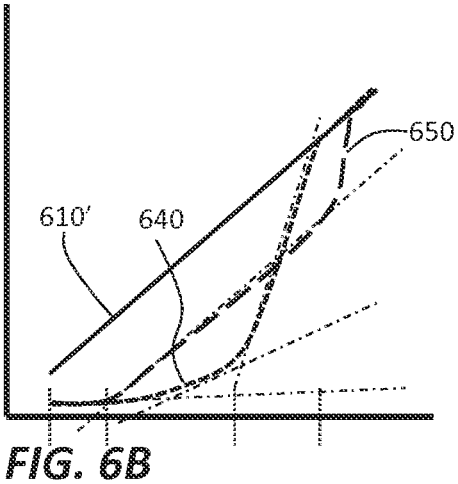
FIG. 6B shows the operating curve of an LED lighting arrangement according to an embodiment.

The skilled person will appreciate that the invention is not limited to the specific control scheme described above with reference to the FIG. 4 and FIG. 5. Provided that, in general, a higher fraction of the driver current is routed through the second string at higher brightness levels, a wide variety of alternative control schemes may be used. FIG. 6B shows two other such control schemes. In each case the complete driver current I driver is directed through the first string 310 of LEDs, as shown at 610'. In one control scheme, the fraction of current which is routed through the second string 320 is determined according to which of four brightness regimes the LED is being operated in, in contrast to the three brightness regimes depicted in FIG. 6A. This is shown at curve 640 which shows four separate regions. The skilled person would appreciate that this control can be established by using an additional error amplifier to modify the circuit of FIG. 4. In another, non-limiting, control scheme, the current 650 through the second string follows that through the first string, but with a constant absolute offset over most of the range.

In order to control the current thought the bypass 34, the controller 330 may sense the currents through the strings or total current from the driver (as described above). In other embodiments, the controller may get one or more dedicated control signals from the driver 350. Thus, as the skilled person will appreciate, in some embodiments, sense resistor may not be required, in order to determine the current through the strings and/or the bypass circuit.

Figure 7:
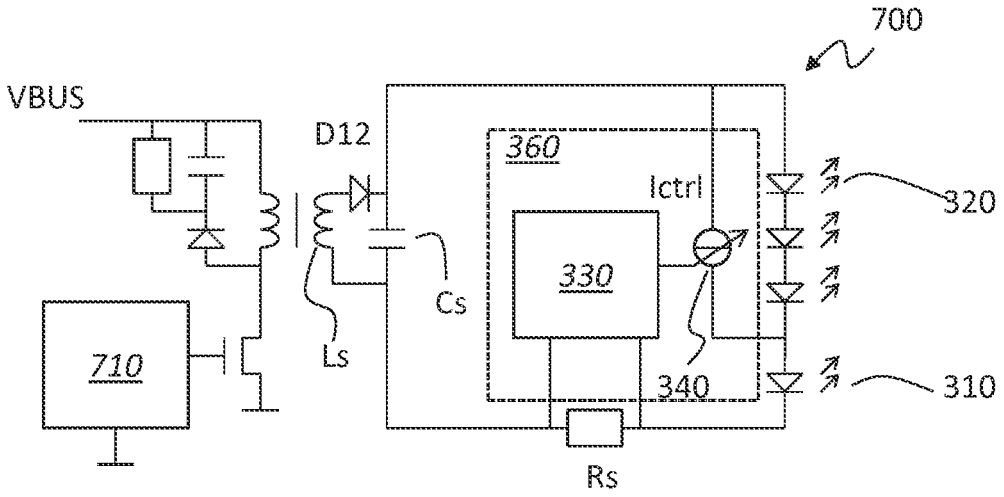
FIG. 7 shows an LED lighting circuit according to embodiments.

FIG. 7 shows, schematically, an LED lighting circuit 700 according to embodiments as described above, and in particular with reference to FIGS. 3A-3B, and including an LED driver, which in this case is shown as a fly-back converter. The driver is controlled by means of a driver controller 710. The flyback converter has a single secondary winding Ls with associated diode D12, and smoothing capacitor Cs. It will be appreciated that although these embodiments may achieve optimum power efficiency for maximum brightness, the efficiency at low brightness may be sub-optimal because of the large difference in total string voltage between the second string (with the white LEDs) and the first string (with the amber LEDs). Thus current through the bypass path, which drops the same voltage as the second string, results in significant power dissipation.

Figure 8:
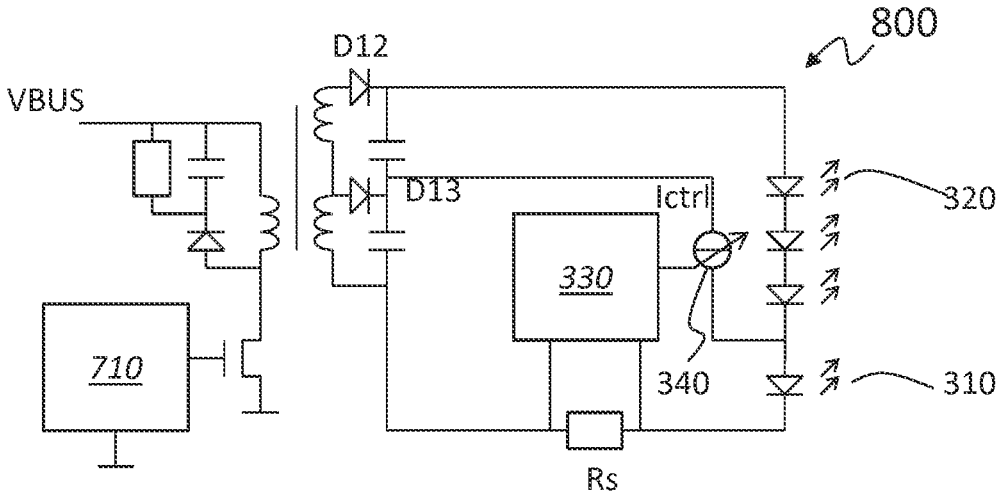
FIG. 8 shows an LED lighting circuit according to other embodiments.

FIG. 8 shows an LED lighting circuit according to other embodiments, which do not suffer so much from that such power dissipation. In these embodiments, the LED driver includes an additional voltage tap on the secondary winding, together with associated rectifier diode 13. The additional tap is configured to provide an output voltage just high enough to supply the first string (of amber LEDs), and thus there is little or no headroom voltage which needs to be dropped in the bypass path, and thus correspondingly little or no power dissipation.

The skilled person will appreciate that the embodiments shown in FIG. 7 and FIG. 8 utilise an LED driver of the fly-back type. The skilled person will immediately appreciate that other embodiments, either having the additional voltage tap as shown in FIG. 8, or a single secondary side output structure shown in FIG. 7, may include or be operable with other types of LED driver, such as, and without limitation, Buck or Buck-boost, LLC topology, and so on.

From reading the present disclosure, other variations and modifications will be apparent to the skilled person. Such variations and modifications may involve equivalent and other features which are already known in the art of LED lighting circuits, and which may be used instead of, or in addition to, features already described herein. In particular and without limitation, the skilled person will appreciate that the controller 360 may be separate to, or may be integrated with the driver controller 710.

Further, although embodiments have been described with reference to white LEDs and amber LEDs, the skilled person will appreciate that the invention is not limited thereto, and in particular extends to other combinations of types of LED, such as, without limitation, red combined with green and amber, and warm white combined with red and green.

In embodiments described above, regulation of the bypass circuit is shown using a form of linear regulation. The skilled person will appreciate that other forms of regulation for the bypass circuit may be appropriate. In particular, the bypass circuit may comprise a switch operable by pulse width modulation, or other form of switch mode regulation. Circuits using such regulation may have an advantage in that it may be possible or appropriate to recycle, rather than dissipate, energy associated with the voltage drop in the bypass circuit.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfill the functions of several means recited in the claims and reference signs in the claims shall not be construed as limiting the scope of the claims.

The invention claimed is:

1. A controller, for a dimmable LED lighting circuit comprising an arrangement of at least one LED of a first type connected in series with at least one LED of a second type, the controller comprising a control circuit, a bypass circuit and a further bypass circuit and being operable for controlling a current, the current being separable into a first part and a second part, and being further separable into a further first part and a further second part, wherein the controller is configured to direct the first part through the at least one LED of the second type and direct the second part through the bypass circuit, wherein the controller is configured to direct the further first part through the at least one LED of the first type and direct the further second part through the further bypass circuit, and wherein the control circuit is configured to adjust, in dependence on an indication of a dimming level of the LED lighting circuit, a current ratio which is at least one of (a) the ratio between the first part and the second part, and (b) the ratio between the further first part and the further second part.

2. A controller as claimed in claim 1, wherein the bypass circuit comprises a controllable current source, and wherein the control circuit includes dimming-adjustment circuitry configured to adjust, in dependence on an indication of a dimming level of the LED lighting circuit, the current ratio over a first range of dimming levels and over a second range of dimming levels, the second range of dimming levels being brighter than the first range of dimming levels.

3. A controller as claimed in claim 2, wherein the bypass circuit comprises a transistor configured to be operated in a linear mode.

4. A controller as claimed in claim 1, further including circuitry configured to supply the first part from a power source having a higher voltage than a power source which supplies the second part.

5. A lighting circuit comprising a controller as claimed in claim 4 configured to supply the first part from a power source having a higher voltage than a power source which supplies the second part, and further comprising: a series arrangement of at least one LED of a first type connected in series with at least one LED of a second type; and an LED driver operable as the power source to supply the first part from a first output and the power source to supply the second part from a second output.

6. A lighting circuit comprising a controller as claimed in claim 4 configured to supply the first and second parts from a single power source, and further comprising: a series arrangement of at least one LED of a first type connected in series with at least one LED of a second type; and an LED driver operable as the power source to provide a drive current.

7. A lighting circuit comprising a controller as claimed in claim 1, further comprising a series arrangement of at least one LED of a first type connected in series with at least one LED of a second type.

8. A controller as claimed in claim 1, further including circuitry configured to supply the first and second parts from a single power source and measuring at least part of the current drawn from the single power source.

9. A lighting circuit comprising a controller as claimed in claim 1, further including: a circuit configured to measure the first part and the second part by assessing voltages at different nodes of the lighting circuit and to generate a signal that corresponds to the indication of the dimming level of the LED lighting circuit; and wherein, in response to the indication of the dimming level, the control circuit is configured to control the ratio in a first dimming range which corresponds to relatively deep dimming levels, and in a second dimming range which corresponds to relatively brighter levels.

10. A controller, for a dimmable LED lighting circuit comprising an arrangement of at least one LED of a first type connected in series with at least one LED of a second type, the controller comprising a control circuit and a bypass circuit and being operable to direct a current comprising a first part and a second part through the at least one LED of the first type, wherein the controller is configured to direct the first part through the at least one LED of the second type and direct the second part through the bypass circuit, and wherein the control circuit is configured to adjust the ratio between the first part and the second part in dependence on a dimming level of the LED lighting circuit.

11. A controller as claimed in claim 10, wherein the bypass circuit comprises at least one of: (a) a pair of transistors connected as an output stage, and configured to operate in linear mode, and (b) a switch operable with pulse width modulation.

12. A controller, for a dimmable LED lighting circuit comprising an arrangement of at least one LED of a first type connected in series with at least one LED of a second type, the controller comprising a control circuit, a bypass circuit and a further bypass circuit and being operable for controlling a current, the current being separable into a first part and a second part, and being further separable into a further first part and a further second part, wherein the controller is configured to direct the first part through the at least one LED of the second type and direct the second part through the bypass circuit, wherein the controller is configured to direct the further first part through the at least one LED of the first type and direct the further second part through the further bypass circuit, wherein the control circuit is configured to adjust at least one of (a) the ratio between the first part and the second part, and (b) the ratio between the further first part and the further second part, in dependence on a dimming level of the LED lighting circuit, and wherein the control circuit is operable to measure the first part and the second part, and comprises:

a first pair of transistors arranged as a first error amplifier operable to adjust the ratio between the first part and the second part over a first range of dimming levels, and a second pair of transistors arranged as a second error amplifier and operable to adjust the ratio between the first part and the second part over a second range of dimming levels, wherein the first and second error amplifiers having at least one transistor in common.

13. A method of controlling an LED lighting circuit comprising an arrangement of at least one LED of a first type connected in series with at least one LED of a second type, the method comprising:

providing a current, wherein the current comprises a first part through the at least one LED of the second type and a second part which bypasses the at least one LED of the second type and wherein the current comprises a further first part through the at least one LED of the first type and a further second part which bypasses the at least one LED of the first type; and adjusting, by use of dimming-adjustment circuitry in dependence on an indication of a dimming level of the LED lighting circuit, a current ratio over a first range of dimming levels and over a second range of dimming levels, the second range of dimming levels being brighter than the first range of dimming levels, wherein the current ratio is at least one of (a) the ratio between the first part and the second part, and (b) the ratio between the further first part and the further second part.

14. The method of claim 13, wherein the first type is an amber LED and the second type is a white LED.

15. The method of claim 13, wherein the at least one LED of the first type is one LED and the at least one LED of the second type is three LEDs.

16. The method of claim 13, wherein the at least one LED of the first type is a first plurality of LEDs and the number of LEDs in the at least one LED of the second type is three times the first plurality of LEDs.

17. A method as claimed in claim 13, further including measuring the first part and the second part.

18. A method as claimed in claim 13, further including: measuring the first part and the second part by assessing voltages at different nodes of the LED lighting circuit; and generating a signal that corresponds to the indication of the dimming level of the LED lighting circuit.

19. A method as claimed in claim 13, further including: measuring the first part and the second part by assessing voltages at different nodes of the LED lighting circuit; generating a signal that corresponds to the indication of the dimming level of the LED lighting circuit; and, in response to the indication of the dimming level, controlling the ratio in a first dimming range which corresponds to relatively deep dimming levels, and in a second dimming range which corresponds to relatively brighter levels.

20. A method as claimed in claim 19, wherein the ratio between the first part and the second part is varied over the second range of dimming levels such that as the brightness increases more of the current is directed through the at least one LED of the second type.

* * * * *